US008137485B2

(12) United States Patent
Seidel et al.

(10) Patent No.: US 8,137,485 B2
(45) Date of Patent: Mar. 20, 2012

(54) PROCESS AND DEVICE FOR PRODUCING STRIPS OF SILICON STEEL OR MULTIPHASE STEEL

(75) Inventors: Juergen Seidel, Kreuztal (DE); Joachim Ohlert, Cologne (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 201 days.

(21) Appl. No.: 12/452,370

(22) PCT Filed: Jul. 21, 2008

(86) PCT No.: PCT/EP2008/005964

§ 371 (c)(1),
(2), (4) Date: Dec. 23, 2009

(87) PCT Pub. No.: WO2009/012963

PCT Pub. Date: Jan. 29, 2009

(65) Prior Publication Data

US 2010/0116380 A1 May 13, 2010

(30) Foreign Application Priority Data

Jul. 21, 2007 (DE) ..... 10 2007 034 124
Jul. 25, 2007 (DE) ..... 10 2007 035 149
Jun. 21, 2008 (DE) ..... 10 2008 029 581

(51) Int. Cl.
*C21D 6/00* (2006.01)

(52) U.S. Cl. ..... 148/548; 148/547

(58) Field of Classification Search ..... 148/547, 148/548

See application file for complete search history.

(56) References Cited

U.S. PATENT DOCUMENTS 4,718,951 A 1/1988 Schoen et al.

(Continued)

FOREIGN PATENT DOCUMENTS

EP 411356 2/1991

(Continued)

OTHER PUBLICATIONS

Dr. J. von Schéele et al., Sauerstoff statt heisser Luft, Energy, v.1., 2003, pp. 18-19.

Sten Ljungars et al. Erfolgreiche Umruestung von Durchlaufoefen auf Oxyfuel-Betrieb, Gaswaerme International, 2005, No. 3, pp. 193-194.

*Primary Examiner* — Scott Kastler

(74) *Attorney, Agent, or Firm* — Abelman, Frayne & Schwab

(57) ABSTRACT

The invention relates to a method for producing strips (1) of steel, preferably of silicon steel, in particular of grain-oriented silicon steel or of multiphase steel in which a slab (3) is initially cast in a casting machine (2), wherein this is then rolled in at least one roll train (4, 5) to form strip (1) and wherein before and/or after the at least one roll train (4, 5), the slab is heated in at least one furnace (6, 7). In order to improve the quality and the scope for producing grain-oriented silicon steel or multiphase steel, the invention provides that the slab (3) is heated to a pre-rolling temperature ($T_1$) after the casting machine (2) and before a pre-roll train (4) in a first furnace (6), or the slab (3) enters into the pre-roll train (4) using the casting heat without the presence of the first furnace (6), the slab (3) is then rolled in the pre-roll train (4), the slab is then heated after the pre-roll train (4) in a second furnace (7) to a defined temperature ($T_2$) that is higher than the pre-rolling temperature ($T_1$), and then the slab (3) is rolled to the final strip thickness in a finish roll train (5).

9 Claims, 3 Drawing Sheets

U.S. PATENT DOCUMENTS

Figure 1:
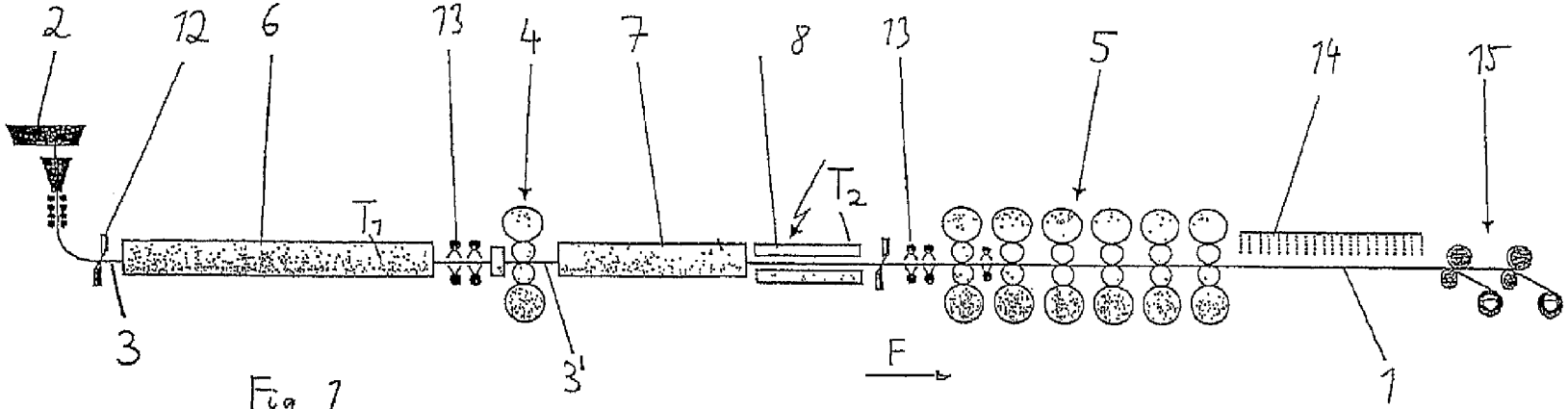

| | | | |
|---|---|---|---|
| 4,898,628 | A | 2/1990 | Block et al. |
| 5,634,257 | A | 6/1997 | Kajuwara et al. |
| 5,769,149 | A | 6/1998 | Mertens |
| 5,783,000 | A | 7/1998 | Axelsson et al. |
| 6,524,400 | B1 | 2/2003 | Pircher et al. |
| 7,343,961 | B2 | 3/2008 | Arvedi |
| 2003/0155040 | A1 | 8/2003 | Schoen et al. |
| 2009/0139609 | A1 | 6/2009 | Gunther et al. |

FOREIGN PATENT DOCUMENTS

| | | |
|---|---|---|
| EP | 1662010 | 5/2006 |
| WO | WO 2005/005670 A1 * | 1/2005 |

* cited by examiner

PROCESS AND DEVICE FOR PRODUCING STRIPS OF SILICON STEEL OR MULTIPHASE STEEL

The invention relates to a method for producing strips of steel, preferably of silicon steel, in particular of grain-oriented silicon steel or of multiphase steel or of a steel having comparatively high alloy content (e.g. micro-alloyed steel) in which a slab is cast in a casting machine, wherein this is then rolled in at least one roll train to form strip and wherein before and/or after the at least one roll train, the slab is heated in at least one furnace. The invention further relates to an apparatus for producing a strip of silicon steel and multiphase steel.

The demand for installations for producing silicon steel has recently increased. In this case, a distinction is made between grain-oriented (GO or CGO and HGO) and non-grain-oriented (NGO) silicon steel. The rolling of non-grain-oriented silicon steels in thin-slab plants is already known. Here this material can be produced very economically and with good quality. There is also an increasing demand for the production of grain-oriented silicon steel.

Grain-oriented silicon steel is presently rolled in conventional hot strip trains. Here, there are various process routes. In one process route in which high-quality grain-oriented silicon steel is produced, the slab is initially pre-rolled before heating. The coarse cast structure is thereby cast into a finer, more homogeneous structure having the highest possible fraction of equi-axial regions. The pre-rolling enlarges the process window and has a favourable effect on the magnetic properties of the end product. Renewed heating to higher furnace temperatures then takes place. In this case, the different types of precipitates which should function as inhibitors during the subsequent process steps are brought into solution as completely as possible. A favourable structure formation is obtained for the subsequent process. Starting from the high temperature, the slab is then finish-rolled in a pre-rolling and finishing train to give thin hot strip.

Details of the said technologies are described, for example, in EP 0 193 373 B1, in DE 40 01 524 A1, in EP 1 025 268 B1, in EP 1 752 548 A1 and in DE 602 05 647 T2.

The production methods presently in use are not yet satisfactory in particular for the production of grain-oriented silicon steel. This applies with regard to the quantities output and to the economic viability during production.

It is therefore the object of the present invention to provide a method and a relevant device with which it is possible to achieve improved results in the production of silicon steel strip, in particular, strip of grain-oriented silicon steel both with regard to the output quantity of strip per unit time and the energy used for the processing, and also the quality of the strip.

Over the last few years, the demand for multiphase steel has likewise undergone a continuous rise. Multiphase steels are usually produced in conventional hot strip trains. In this case, as a result of the temperature difference over the length on entry into the finishing train, it must be accepted that the rolling speed will vary over length in order to adjust a constant end rolling temperature. The increasing speed of the strip over the length leads to difficulties in adjusting a homogeneous structure over the length in the cooling section since multiphase steels must be subjected to complex temperature-time cycles. The heating before the rolling also serves the purpose of homogenising the relatively coarse and non-uniform casting structure which, however, is only possible to a limited extent. Overall the production methods for producing multiphase steels are not yet satisfactory.

It is therefore further the object of the present invention to provide a method and a relevant device with which it is possible to achieve improved results in the production of multiphase steel, both with regard to the output quantity of strip per unit time and the energy used for the processing and also the quality of the strip.

The solution of this object by the invention is characterised according to the method by heating the slab to the pre-rolling temperature after the casting machine and before a pre-roll train in a first furnace, then heating the slab in the pre-roll train, then heating the slab after the pre-roll train in a second furnace to a defined temperature that is higher than the pre-rolling temperature, and then rolling the slab to the final strip thickness in a finish roll train.

Alternatively, the first furnace is dispensed with and the slab is rolled in the pre-roll train using the casting temperature directly in-line with the casting machine. Then, as described previously, heating to a higher temperature and the finish rolling take place.

In this case, the pre-rolling temperature is preferably between 1000° C. and 1200° C. and the defined temperature before the finishing train is between 1150° C. and 1350° C., in particular above 1200° C. for silicon steel and below 1300° C. for multiphase steel.

In the case of processing multiphase steel, the strip can be held at the elevated temperature, preferably at 1150° C. to 1300° C. for a predefined holding time until non-uniform distributions of alloying elements (segregations) are at least partially, preferably completely, broken down. Meanwhile, in the case of processing grain-oriented silicon steel, the strip can be held at the elevated temperature, preferably at 1200° C. to 1350° C. for a predefined holding time until the different types of segregations are at least partially, preferably completely, brought into solution.

In this case, during the pre-defined holding time the strip can be kept in a conveyor or in a furnace in or adjacent to the main transport line.

The heating to the higher temperature can take place at least partly by induction heating. It can also take place at least partly by direct flame impingement on the slab. In the latter case, it is preferably provided that the direct flame impingement on the slab is effected by a gas jet comprising at least 75% oxygen in which a gaseous or liquid fuel is mixed. However, indirect flame impingement of a conventional type using an oxygen-fuel mixture (oxyfuel method) is also provided.

A further embodiment of the inventive proposal provides that the rolling of the slab takes place in batch mode. Alternatively, it can be provided that the rolling of the slab takes place in continuous mode depending on the end thickness to be rolled, the casting speed and the material.

The previously described operating mode comprising the steps of casting, pre-rolling at a first temperature and subsequent heating to an elevated temperature, and finish rolling can take place both for silicon steels and also for micro-alloyed steels and multiphase steels.

The apparatus for producing a strip of silicon steel, in particular of grain-oriented silicon steel, or of multiphase steel is characterised according to the invention in that a first furnace is arranged between the casting machine and a pre-roll train, with which the slab can be heated to the pre-rolling temperature. Alternatively the casting heat is used, and the pre-roll train is arranged directly after the casting installation. Furthermore, a second furnace is arranged after the pre-roll train and before a finish-roll train with which the slab can be heated to an elevated temperature, the second furnace being configured as a high-temperature furnace. In an alternative embodiment, a coil box is additionally arranged after the pre-roll train as a pre-strip store.

The second furnace preferably comprises a combination of conventional furnace and induction heater. It can also comprise a device for direct flame impingement on the slab. Furthermore the second furnace can comprise a conventional furnace.

Firstly a conventional furnace and then an induction heater or a device for direct flame impingement on the slab can be arranged in the conveying direction of the slab. An alternative provides that initially an induction heater or a device for direct flame impingement on the slab and then a conventional furnace are arranged in the conveying direction of the slab. A further alternative provides that firstly a conventional furnace and then an induction heater or a device for direct flame impingement on the slab and then a further conventional furnace are arranged in the conveying direction of the slab. Finally it can also be provided that firstly an induction heater or a device for direct flame impingement on the slab, then a conventional furnace and then a further induction heater or a device for direct flame impingement on the slab are arranged in the conveying direction of the slab.

Parts of the first furnace or the second furnace can also be executed at least in part as conveyors (in particular, pendulum or transverse conveyors or coil conveyors so that in a double-strand casting plant, both thin slabs are pushed into the rolling line and rolled out on the roll train (or on the roll trains).

Furthermore, a single-strand casting plant comprising at least one pendulum or transverse conveyor or coil conveyor is also possible to allow storage of a thin slab or deformed thin slab in a conveyor or in a parallel furnace.

Shears are preferably arranged before the first furnace.

The first roll train can consist of a single rolling stand or of a plurality of rolling stands.

A vertical casting machine or a bow type continuous casting machine can be used.

A further development provides that a roller table encapsulation is provided which can be pivoted or brought into the production line instead of a conventional furnace or instead of the induction heater.

A coilbox can be placed after the pre-roll train.

The at least one induction heater or the at least one device for direction flame impingement on the slab can be arranged displaceably in the direction transverse to the conveying direction of the slab. In this case, it can be provided that at least one conventional furnace is provided which is arranged displaceably in the direction transverse to the conveying direction of the slab in order to replace the induction heater or the device for direct flame impingement.

A further development provides that the first furnace arranged in front of the pre-roll train comprises a device for direct or indirect flame impingement on the slab in which an oxygen-fuel mixture is used.

According to one embodiment of the apparatus, the pre-roll train can be arranged directly without the presence of the first furnace behind the casting installation.

Parts of the first furnace or the second furnace can be designed as a conveyor. In this case, it is preferably provided that the conveyor is configured as a pendulum or transverse conveyor or as a coil conveyor to allow storage of a thin slab or a deformed thin slab in a furnace adjacent to the main transport line of a single or double-strand casting plant.

The furnace can serve as a production buffer, for example, during a roll change. Furthermore, the furnace is provided for specifically holding the slabs at the elevated temperature before the finish rolling for metallurgical reasons (e.g. compensating for segregations, bringing precipitates into solution).

Means for high-pressure descaling can be provided before the pre-deformation of the slab. These are preferably configured for operation at a pressure between 400 and 600 bar.

The apparatus can further comprise straightening or hold-down rollers and/or a camera for detection of turn-down. The straightening or hold-down rollers and/or the camera are preferably arranged in front of an induction heater.

In all the variants of the apparatus according to the invention, it can be provided that at least one set of crop shears is arranged directly before the induction heater (instead of behind the induction heater) to eliminate any turn-down.

Two sets of crop shears can be arranged one behind the other without a roll stand located in between. At the same time, the two sets of crop shears can be differently configured, whereby it is possible to use the one or the other set of shears individually to adapt to different transport speeds of the deformed thin slabs.

The concept of the invention is based on the CSP technology known per se. This is to be understood as thin slab—thin strip—casting/rolling mills which can be used to achieve efficient production of hot strip when the rigid combination of strip casting plant and roll trains and its temperature management is controlled by the entire plant. Depending on the operating mode in the conventional hot strip train, after casting, the thin slabs are therefore heated again to some extent or the casting temperature is used, they are then pre-rolled, brought to a higher temperature for a second time and then finish rolled.

Since the production in CSP plants is a very economical process and also has some advantages with regard to the structure development, with the proposed procedure the advantages of this technology also have an effect in the production of silicon steel strip and multiphase steels. As a result, favourable conditions are achieved with a view to the fundamental advantages of the CSP plant and process safety.

Figure 2:
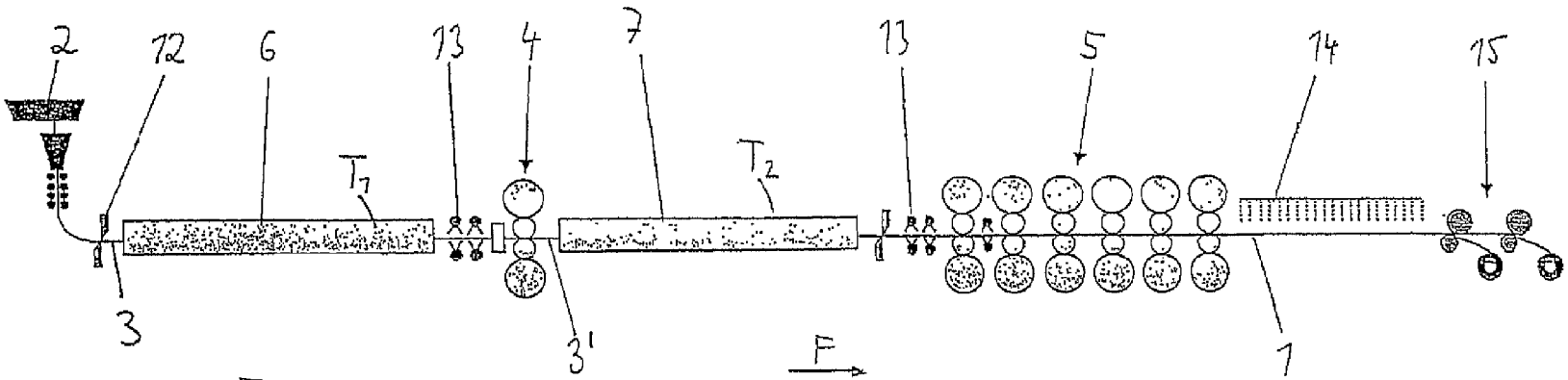
Figure 3:
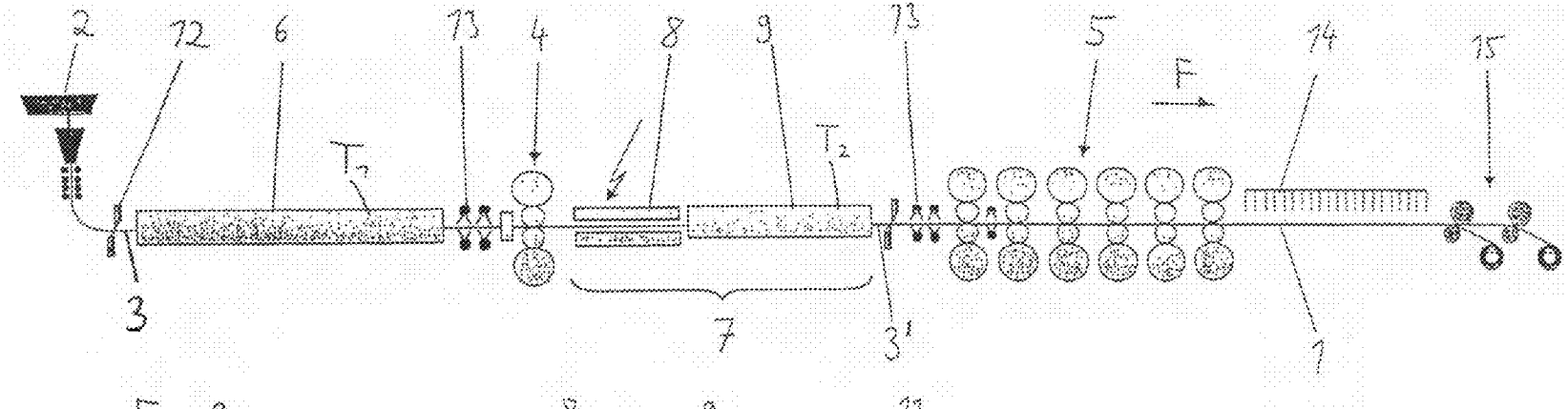
Figure 4:
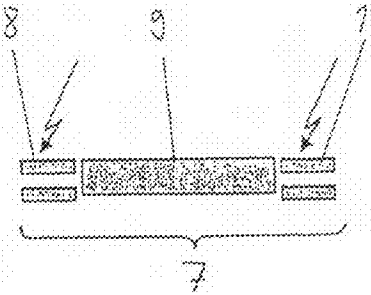
Figure 5:
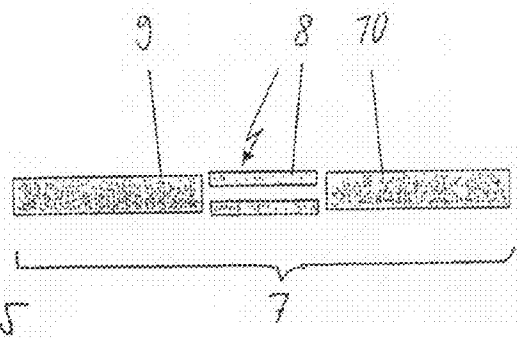
Figure 6:
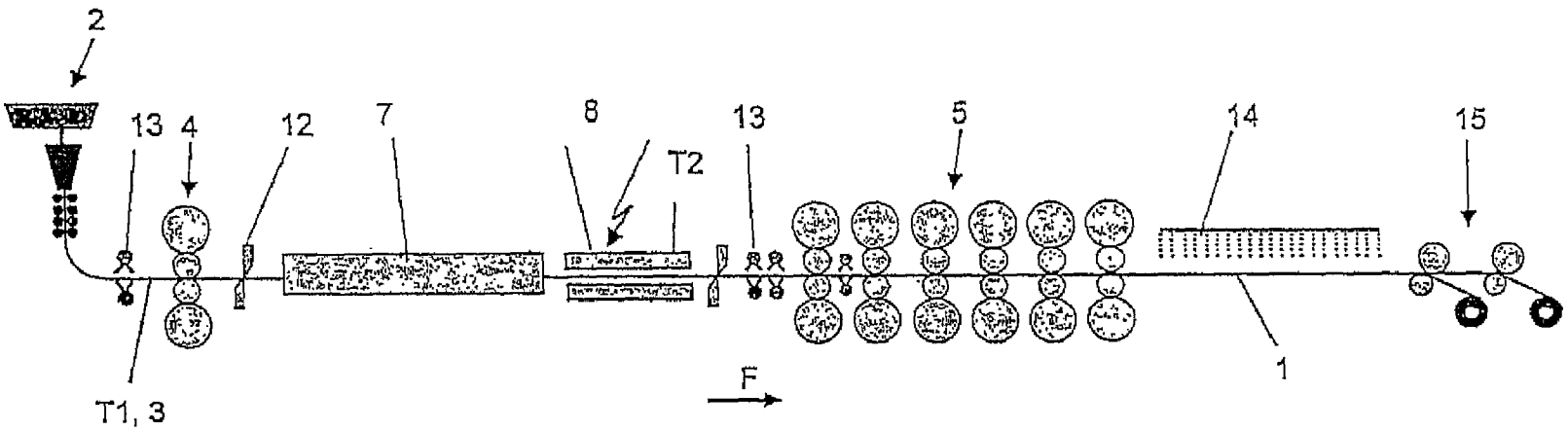

Exemplary embodiments of the invention are shown in the drawings. In the figures:

FIG. 1 shows a schematic view of casting/rolling plant according to a first embodiment of the invention comprising a casting machine, first furnace, pre-train, second furnace and finishing train, FIG. 2 shows an alternative embodiment of the casting/rolling plant with respect to FIG. 1, FIG. 3 shows another alternative embodiment of the casting/rolling plant with respect to FIG. 1, FIG. 4 shows the second furnace of the casting/rolling plant in an alternative embodiment, FIG. 5 shows the second furnace of the casting/rolling plant in another alternative embodiment, FIG. 6 shows schematically a casting/rolling plant without a first furnace with an in-line arrangement of casting machine and pre-roll train.

FIG. 1 shows a schematic view of an embodiment of a thin slab plant on which the method according to the invention for producing strip 1 of grain-oriented silicon steel and multiphase steel can be carried out. A vertical casting machine 2 is provided in which slabs 3 approximately 70 mm thick are cast. Cutting to the desired slab length takes place at shears 12. This is followed by a first furnace 6 in which the thin slab 3 is brought to a pre-rolling temperature $T_1$ of about 1000 to 1200° C. and in which a certain temperature equalisation is obtained in the width direction.

This is then followed by the pre-rolling in a pre-roll train 4 consisting of one or a plurality of stands and in which the slab 3 is rolled to an intermediate thickness. Rolling comprising a smooth pass or a high reduction of, for example, 65% is possible.

During the pre-rolling, the casting structure is converted into the finer-grained rolling structure. The furnace inlet temperature can also be influenced by the choice of rolling speed at the strand of the pre-roll train 4. In order to achieve properties which are as uniform as possible over the entire cross-section of the thin slab, the use of descaling sprays 13 is optionally dispensed with during the pre-rolling of grain-oriented silicon steel in the pre-rolling train 4.

A second furnace 7 in the form of a holding furnace or temperature equalising furnace is provided after the stand of the pre-roll train 4. The second furnace 7 provides at least sufficient space to accommodate a pre-deformed thin slab. It can also be provided that cycling or dwelling of the pre-deformed thin slab takes place in the furnace. Instead of a holding furnace 7, it is also possible to provide a roller table encapsulation at this point (for the processing, for example, of normal steel). Alternatively, a coilbox can be placed after the pre-roll train 4 as a space-saving pre-strip store.

Following this is an induction heater 8 with which the thin slab 3 can be brought to the desired elevated temperature $T_2$ relatively uniformly over the cross-section. For the rolling of grain-oriented silicon steel, a temperature range of about 1200 to 1350° C. is provided behind the induction heater 8. With this method the precipitates are released by the high temperatures and advantageous conditions are created for the subsequent re-precipitation of the elements now present in dissolved form, which ensures the attainment of the desired properties in the end product.

During the rolling of multiphase steels, heating to, for example, 1150° C. to 1300° C. is provided.

The induction heating is therefore provided for intensive heating above 1150° C. The heating is followed by the finish rolling in the finish roll train 5, i.e. in a multi-stand finish roll step to the desired finished strip thickness and finished strip temperature and then the strip cooling in a cooling section 14 and finally the reeling onto a coiler 15.

During the rolling of normal steel on the plant shown only (normal) temperatures of about 1100 to 1150° C., in particular cases possibly even lower, are required after the induction heating 8, i.e. the thin slab can be flexibly heated, if necessary to high or lower temperatures after the pre-deforming.

For economical heating or processing of, for example, normal steel it is optionally also provided that the induction heating 8 is designed to be transversely displaceable so that alternatively, instead of the induction heating 8, a conventional furnace (such as the first furnace 6) can be pushed into the transport line.

It is furthermore alternatively provided, instead of the induction heating 8, to carry out high temperature heating using the so-called DFI oxyfuel method (DFI: direct flame impingement) or the conventional oxyfuel method. For this method, reference is made to EP 0 804 622 B1 as well as to the contribution of J. v. Schéele et al. "Oxygen instead of hot air" Energy 01/2005, page 18-19, GIT Verlag GmbH & Co. KG, Darmstadt as well as S. Ljungars et al. "Successful retrofitting of continuous furnaces to oxyfuel operation" GASWÄRME International, 54, No. 3, 2005.

This comprises a special furnace in which pure oxygen instead of air and gaseous or liquid fuel is mixed and the flame is partly directed onto the slab. This not only optimises the combustion process but also reduces nitrogen oxide emissions. The scale properties are also favourable or the scale growth is small. With this method high heat densities similar to those in induction heating can be achieved with high efficiency. Furthermore, a minimal oxygen excess or oxygen deficit can be adjusted during the combustion.

It is optionally also possible to equip the entire heating region behind the pre-rolling trains only with the DFI oxyfuel furnace or with the conventional oxyfuel furnace, i.e. the high temperature furnace, to avoid using two different heating systems (induction, flame) in one plant. Such a solution is illustrated in FIG. 2.

In order to keep the scale formation in the first furnace 6 low and reduce the furnace length, in a further embodiment of the invention it is provided to likewise equip the first furnace 6 after the casting machine 2 with the efficient DFI oxyfuel process even if temperatures of only about 1150° C. are set here.

The DFI oxyfuel method can advantageously be used for thin slab heating in plant variants having no rougher. This applies particularly if little scale is to be formed and the furnace length should be short.

Other alternatives, especially various furnace arrangements behind the pre-roll train 4 are shown in FIGS. 3, 4 and 5.

In this case, FIG. 3 shows the arrangement of an induction heater 8 directly after the pre-deformation in the stand of the pre-roll train 4. The induction heating 8 is followed by a conventional furnace 9. With this arrangement, a longer dwell (holding) at high temperatures can be achieved. This is provided for adjusting desired metallurgical properties for silicon steel and multiphase steel.

In FIG. 4 the induction heating is divided, i.e. into a front induction heating 8 in the conveying direction F and a rear induction heating 11, a conventional furnace 9 being arranged between the two induction heaters 8, 11.

In FIG. 5 the conventional furnace 9 and 10 is divided behind the pre-deformation group; the induction heater 8 is located in between. Instead of the induction heater 8, the DFI oxyfuel heating can also be provided here. In this case the dwell time behind the pre-deformation group can be further increased.

In order to lengthen the storage time in the furnace at elevated temperatures, conveyors and furnaces are additionally provided next to the main transport line as additional stores.

The proposed plant configuration exhibits scope for a high-temperature furnace after a pre-deformation group consisting of the combination of a conventional furnace with an induction heater or a special furnace using DFI oxyfuel technology. Normal materials can be produced by this means as well as special materials, in particular grain-oriented silicon steels. That is, in this thin slab plant the temperature control can be flexibly adapted so that the special grain-oriented silicon steel but also normal steels such as, for example, soft C steel or micro-alloyed steels can be rolled.

As has been mentioned, conventional furnaces, roller table encapsulations, special furnaces and/or induction heaters in any order can be arranged between the pre-deformation and the finish rolling. The induction heating is optionally transversely displaceable so that this can be exchanged with a conventional furnace.

The temperature control in the furnace behind the pre-deformation can be individually adjusted depending on the material produced (grain-oriented silicon steel, multiphase steel or normal steel).

The descaling of the grain-oriented steel takes place shortly before the pre-deformation, if at all, preferably with a small amount of water of less than 50 $m^3/h/m$ and high pressure higher than 400 to 600 bar.

It is provided by means of process control (casing speed, rolling speed during pre-deformation, tracking) to influence the furnace inlet temperature and control the holding time in the furnace behind the pre-deformation group.

A DFI oxyfuel furnace is optionally also provided for heating the thin slabs directly behind the casting machine 2 and specifically for CSP plants with and without pre-deformation.

FIG. 6 shows schematically an alternative embodiment of a thin slab plant. Here the heating in a first furnace (before the first roll train 4) is omitted and instead the casting heat is used. Directly after a casting plant 2, following the high-pressure descaling 13 the thin slab 3 is rolled in-line at a temperature $T_1$ of about 1000° C. to 1200° C. in the pre-rolling train 4. The inlet temperature $T_1$ is controlled by adjusting the continuous casting cooling and casting speed. In this variant, the casting plant and the pre-rolling group are coupled. On reaching the desired intermediate strip length, cutting takes place at the shears 12 behind the pre-rolling train 4. The furnace 7 can be dimensioned so that the intermediate strip fits therein. The further processing, i.e. heating to the elevated temperature $T_2$ and finish rolling etc. takes place in the manner described previously. Alternatively or additionally, a coilbox is arranged behind the pre-rolling train 4 and shears 12 as a space-saving pre-strip store.

As a special case, the plant shown can additionally be operated in continuous mode, alternatively or as desired. That is the casting machine and the pre-rolling and finish rolling train are coupled to one another and the rolling then takes place at the casting speed. Cutting to the desired strip length then takes place during the continuous rolling shortly before the coiler. For changing the rolls, a switchover from continuous to batch operation again takes place beforehand. For changing the rolls the casting speed is reduced and/or the finish train draw-in speed is increased.

For mechanical protection of the induction heating from damage, straightening or hold-down rollers and/or a camera for detection of turn-down are provided after the pre-deformation or before the induction heating and individual influencing of the working roll speeds and different diameters at the rougher to avoid turn-down.

Alternatively, as already mentioned, different material can naturally also be processed on the plant described.

However, the temperature control is adapted depending on the material and different defined temperatures $T_2$ are set before the finish roll train 5 and the described components in the second furnace 7 are used or activated.

Whereas with normal steel the second furnace 7 functions predominantly as a holding furnace, in the case of silicon steel but additionally with different micro-alloyed steels or multiphase steels, after the pre-roll train a defined elevated temperature (e.g. higher than 1150° C. to 1350° C.) is set in the second furnace 7 and thus the properties are positively influenced. That is, the invention or adjustment of the elevated intermediate temperature $T_2$ is not only restricted to silicon steel but is also provided for micro-alloyed steels and multiphase steels.

REFERENCE LIST

1 Strip
2 Casting machine
3 Slab
3' Formed slab
4,5 Roll train
4 Pre-rolling train
5 Finish roll train
6 First furnace
7 Second furnace (high-temperature furnace)
8 Induction heating/device for direct flame impingement of the slab
9 Conventional furnace
10 Conventional furnace
11 Induction heating/device for direct flame impingement of the slab
12 Shears
13 Descaling sprays
14 Cooling section
15 Coiler
F Conveying direction
$T_1$ Pre-rolling temperature
$T_2$ Defined elevated temperature before the finish rolling

The invention claimed is:

1. A method of producing strips of silicon steel, comprising the steps of:
casting a slab in a casting machine;
hot-rolling the slab in a pre-roll train;
heating the slab in a furnace after pre-rolling to a predetermined temperature in a range of 1,150° -1,350° C.;
holding the slab at the predetermined temperature for a predetermined holding time until non-uniform distributions of alloying elements (segregation) are completely broken down; and
thereafter, finish-rolling the slab to a predetermined slab thickness.

2. The method according to claim 1, comprising the step of heating the slab after casting to a pre-rolling temperature.

3. The method according to claim 1 in which the slab-heating step includes heating the slab to a temperature from 1,150° -1,300° C. when the silicon steel, the slab is cast from, is a multi-phase steel, and heating the slab to a temperature from 1,200° -1,350° C. when the silicon steel, the slab is cast from, is a grain-oriented steel.

4. The method according to claim 2, wherein the pre-rolling temperature is in a range between 1,000° and 1,200° C.

5. The method according to claim 1, wherein the slab-holding step includes holding the heated slab in one of conveyor, furnace, and in a line adjacent to one main transport line.

6. The method according to claim 1, wherein the slab-heating step includes heating the slab, at least partially, by induction heating.

7. The method according to claim 1, wherein the slab-heating step includes heating the slab, at least partially, by subjecting the slab to direct flame impingement.

8. The method according to claim 7, wherein the direct flame impingement on the slab (3) is effected by a gas jet comprising at least 75% oxygen in which a gaseous or liquid fuel is mixed.

9. The method according to claim 1, wherein slab casting is carried out in a batch mode.

* * * * *